US008123447B2

(12) United States Patent
Richter et al.

(10) Patent No.: US 8,123,447 B2
(45) Date of Patent: Feb. 28, 2012

(54) METHOD AND APPARATUS FOR BACKING PRINTED PRODUCTS

(75) Inventors: Lutz Richter, Schkeuditz (DE); Siegmar Tischer, Borsdorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1421 days.

(21) Appl. No.: 11/353,679

(22) Filed: Feb. 14, 2006

(65) Prior Publication Data

US 2006/0182521 A1 Aug. 17, 2006

Related U.S. Application Data

(60) Provisional application No. 60/652,630, filed on Feb. 14, 2005.

(30) Foreign Application Priority Data

Feb. 15, 2005 (DE) ..... 10 2005 006 773

(51) Int. Cl.

| | |
|---|---|
| ***B42C 11/00*** | (2006.01) |
| ***B42C 9/00*** | (2006.01) |
| ***B42C 11/02*** | (2006.01) |
| ***B42C 11/04*** | (2006.01) |
| ***B42C 13/00*** | (2006.01) |
| ***B42C 5/00*** | (2006.01) |
| ***B42C 5/02*** | (2006.01) |
| ***B42C 5/04*** | (2006.01) |

(52) U.S. Cl. ..... 412/4; 412/1; 412/5; 412/6; 412/8; 412/9; 412/10; 412/19; 412/21; 412/22; 412/24; 412/29; 412/30; 412/33; 412/36; 412/37; 412/902

(58) Field of Classification Search ..... 270/30.01, 270/52.01, 52.08, 52.16, 52.18, 52.26, 52.29, 270/58.08, 58.09, 58.29; 412/1, 4, 5, 6, 8, 412/9, 10, 17, 18, 19, 21, 22, 24, 29, 30, 412/33, 36, 37, 900, 902

See application file for complete search history.

(56) References Cited

U.S. PATENT DOCUMENTS

| | | | | |
|---|---|---|---|---|
| 2,160,728 | A | 5/1939 | Grammer | |
| 5,678,813 | A * | 10/1997 | Osako et al. | 270/52.16 |
| 6,363,851 | B1 * | 4/2002 | Gerhard et al. | 101/483 |
| 2002/0076304 | A1 * | 6/2002 | Voss | 412/5 |
| 2004/0108642 | A1 * | 6/2004 | Stolz et al. | 270/52.18 |
| 2004/0214706 | A1 | 10/2004 | Dannemann et al. | |
| 2004/0265095 | A1 * | 12/2004 | Blohm et al. | 412/1 |
| 2005/0008460 | A1 | 1/2005 | Watkiss | |

FOREIGN PATENT DOCUMENTS

| | | |
|---|---|---|
| EP | 1 005 984 | 6/2000 |
| EP | 1 475 339 | 11/2004 |
| EP | 1 479 528 | 11/2004 |

* cited by examiner

*Primary Examiner* — Dana Ross
*Assistant Examiner* — Justin Lewis
(74) *Attorney, Agent, or Firm* — Laurence A. Greenberg; Werner H. Stemer; Ralph E. Locher

(57) ABSTRACT

A method for backing printed products includes feeding signatures to a transport and stitching line of a gatherer stitcher by a plurality of feeders. A plurality of signatures are gathered on the transport and stitching line and forms a folded sheet assembly. The folded sheet assembly is stitched to form a brochure along the transport and stitching line. The spine of the brochure is backed along the transport and stitching line by a pressing apparatus.

15 Claims, 5 Drawing Sheets

FIG. 2A
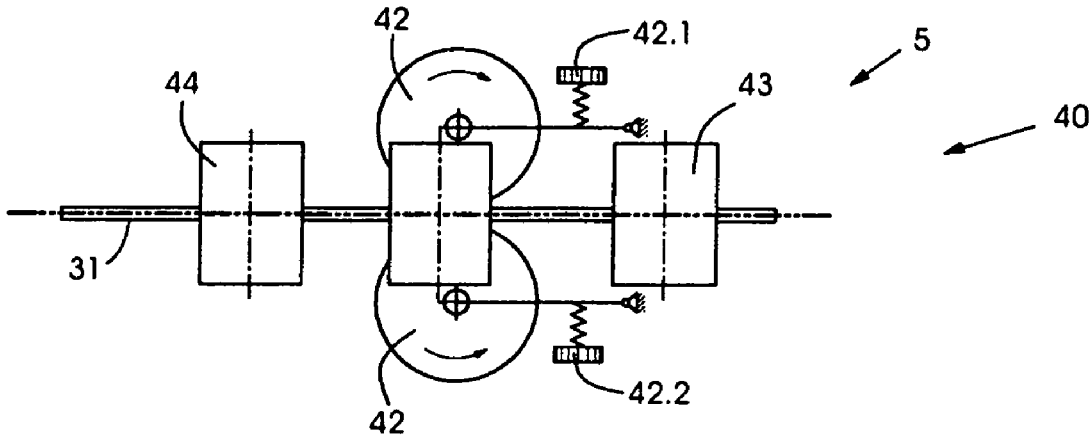
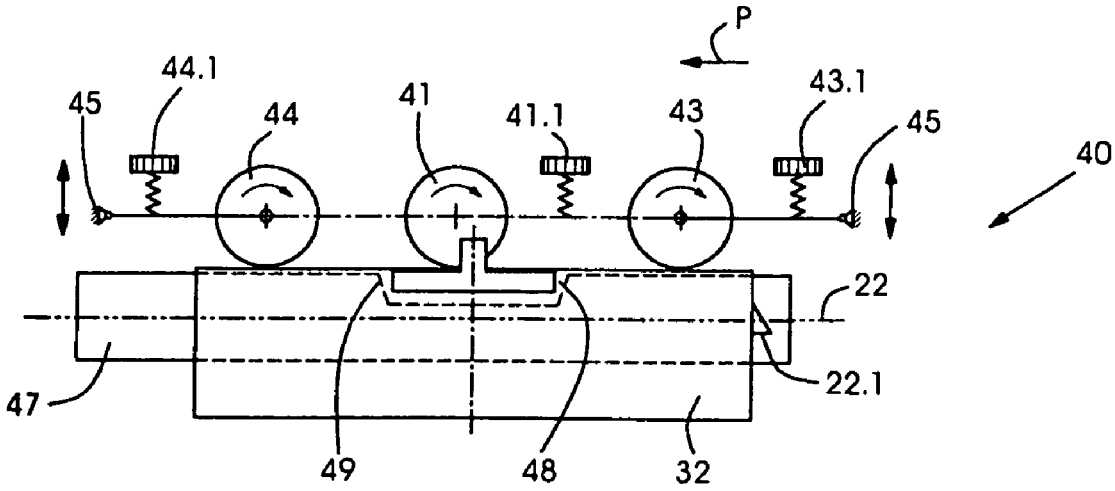
FIG. 2B

METHOD AND APPARATUS FOR BACKING PRINTED PRODUCTS

CROSS-REFERENCE TO RELATED APPLICATIONS

This application claims the benefit under 35 U.S.C. §119 (e) of provisional application No. 60/652,630, filed Feb. 14, 2005; this application also claims the priority, under 35 U.S.C. §119, of German patent application No. 10 2005 006 773.5, filed Feb. 15, 2005; the prior applications are herewith incorporated by reference in their entirety.

BACKGROUND OF THE INVENTION

Field of the Invention

The invention relates to a method for backing printed products according and to an apparatus for backing printed products. The apparatus contains a transport and stitching line, a plurality of feeders disposed along the transport and stitching line, and a stitching station disposed downstream of the feeders along the transport and stitching line.

In this description, the terms signature, folded sheet assembly and brochure will be used. In this case, signature is understood to be a single-piece flat element, for example a paper sheet or cover. The signatures can be present in the feeders of the gatherer stitcher in single or multi-folded form, or unfolded in what is known as a cover feeder, in which a fold is introduced into the signature as it is deposited on the transport and stitching line gathering section. The stacks lying loosely one above another and therefore unstitched on the transport and stitching line will be designated a folded sheet assembly. As a result of stitching, the folded sheet assembly becomes a brochure, in which the signatures are firmly connected to one another.

Gatherer stitchers according to the invention are marketed, for example, by Brehmer Buchbindereimaschinen GmbH, Leipzig under the type designation ST400 and are configured in such a way that, until stitching and subsequent provision in the output station, the brochures are transported in the longitudinal direction of the spines of the brochures and, in the output station, are transferred by an ejector to delivery belts. The delivery belts then convey the brochures onward transversely with respect to their previous transport direction, specifically in the direction of a trimmer, in which first a front-edge cut and then a top cut and a bottom cut are made.

Stitched-spine brochures are typically thicker on the stitched side than on the open side. If brochures of this type are brought above one another, they tend to produce a crooked, cumbersome stack which, beginning at a certain height, has to be stabilized, for example by cross laying, banding or other techniques. If such brochures are set up vertically, they have only a narrow edge, which provides the viewer with less information about the content of the brochure than would be the case with printed products with a straight spine. It is therefore desirable to bring a stitched-spine printed product into a form which does not have these disadvantages, specifically is substantially parallelepipedal.

To this end, there are various approaches from the prior art. From European patent EP 1 005 984, corresponding to U.S. Pat. No. 6,363,851, it is known to produce a printed product with a rectangular spine in that, before the printed products are laid on one another, in each case two mutually spaced weakening lines are made, the mutual spacing of the weakening lines being increased in successive printed products.

European patent application EP 1 475 339 discloses pressing the folding edge before collation during the production of printed products.

European patent EP 1 479 528, corresponding to U.S. patent publication No. 2005/0008460 A1, discloses bringing a stitched printed product into a rectangular form when at a standstill by use of press rolls.

SUMMARY OF THE INVENTION

It is accordingly an object of the invention to provide a method and apparatus and method for backing printed products which overcomes the above-mentioned disadvantages of the prior art devices and methods of this general type, with which the production of a stitched-spine printed product can be incorporated particularly well into the production of the printed product.

With the foregoing and other objects in view there is provided, in accordance with the invention, a method for backing printed products. The method includes the steps of: feeding signatures to a transport and stitching line of a gatherer stitcher using a plurality of feeders; gathering the signatures on the transport and stitching line for forming a folded sheet assembly; stitching the folded sheet assembly to form a brochure along the transport and stitching line; and backing a spine of the brochure along the transport and stitching line using a pressing apparatus.

Accordingly, the method according to the invention is distinguished in particular by the step of backing the spine of the brochure along the transport and stitching line of a gatherer stitcher. By this "in-line" production of stitched-spine printed products with a rectangular spine, the higher processing speeds that are usual in gathering stitching technology can be achieved and, at the same time, an attractive printed product can be produced. In addition, by the backing of the spine region of the stitched product, the stability of the product is increased considerably, which has a positive effect on the handling of the product by downstream processing devices, such as cross layers, packaging machines, insertion machines, strapping devices, film-wrapping devices and so on. In addition the products backed in this way are flatter, so that they stick up or gape less. As a result of the good planarity of the product, this is particularly advantageous in the case of products in which a stack has to be produced, for example in a cross layer.

In an advantageous refinement of the method according to the invention, the method contains the additional step of the thickness inspection/thickness measurement of the collated brochure on the gathering chain. As a result, first, conclusions can be drawn as to whether the brochure is complete, but also second, from the thickness measurement, other parameters for the optimization of the method can be derived, for example the setting of the pressing elements of the pressing apparatus as a function of the thickness of the brochure. As a result, the considerable forces arising during the backing are matched to the respective product in such a way that, first, the forces are sufficiently high to achieve the desired deformation of the spine of the brochure but, second, the forces are sufficiently low that damaging the brochure by pressing forces set excessively high is reduced.

In a further advantageous refinement of the method according to the invention, the measured values from the thickness inspection are additionally used to introduce two mutually parallel creases spaced apart from each other into a cover, which is supplied to the transport and stitching line by a folded cover sheet feeder, the distance between these creases corresponding exactly to the thickness of the folded sheet assembly. This leads to an esthetic visual appearance of the finished printed product.

Other features which are considered as characteristic for the invention are set forth in the appended claims.

Although the invention is illustrated and described herein as embodied in a method and apparatus for backing printed products, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 2A is a diagrammatic, plan view of details of a first embodiment of a pressing apparatus according to the invention;

FIG. 2B is a side-elavational view of details of the first embodiment of the pressing apparatus according to the is invention;

DESCRIPTION OF THE PREFERRED EMBODIMENTS

Figure 1:
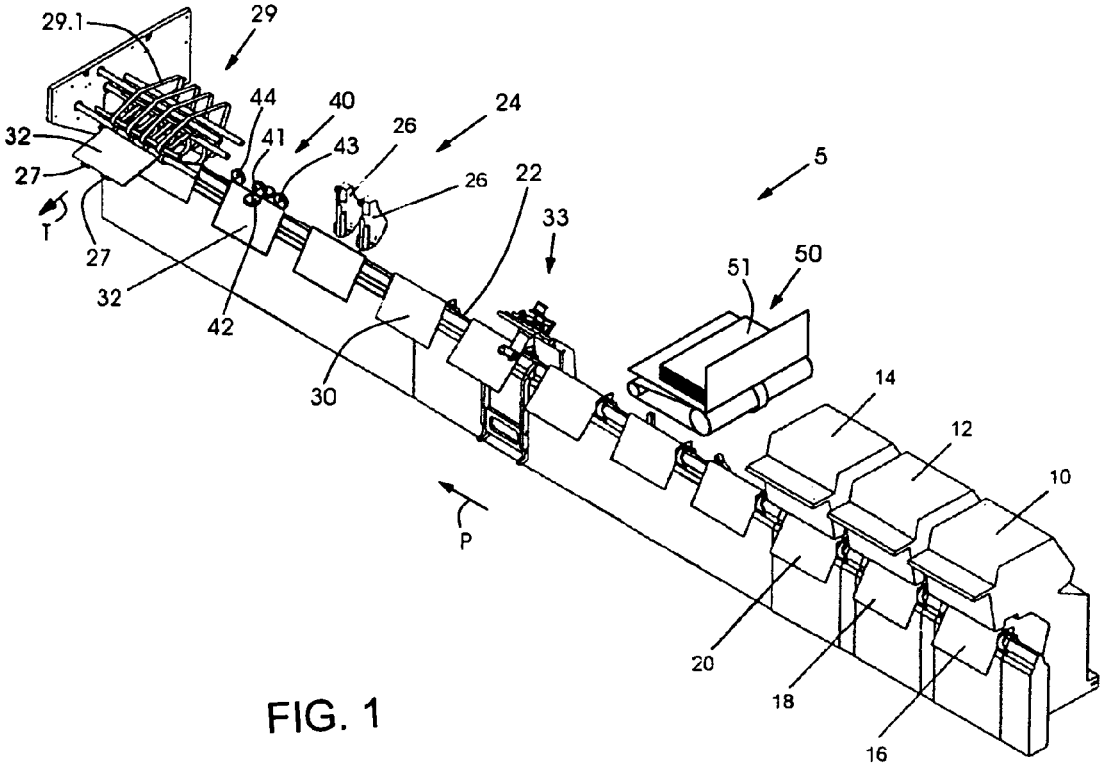
FIG. 1 is a diagrammatic, perspective simplified view of an embodiment of a gatherer stitcher according to the invention for backing printed products.

Referring now to the figures of the drawing in detail and first, particularly, to FIG. 1 thereof, there is shown a gatherer stitcher which contains three folded sheet feeders 10, 12, 14, which each transfer a signature 16, 18, 20 to a transport and stitching line 22. The signatures 16, 18, 20 placed under and over one another in this way together form a folded sheet assembly 30, which is transported in a transport direction according to arrow P along a transport and stitching line 22, which extends along the folded sheet feeder 10, 12, 14 and beyond a stitching station 24 as far as an output station 29 having delivery belts 29.1. By use of the delivery belts 29.1, a stitched-spine and backed brochure 32 is transported in a direction of the arrow identified by the letter T to a following non-illustrated trimmer, in order to be trimmed on the three open sides.

Between the folded sheet feeders 10, 12, 14 and the stitching station 24, a folded cover sheet feeder 50 is shown by way of example in this embodiment, which initially folds a cover 51 and then deposits it on the folded sheet assembly 30 on the transport and stitching line 22. In a further embodiment, the folded cover sheet feeder 50 has a known creasing device, with which creases (weakening lines) can be introduced into the cover 51. In this case, in a particularly advantageous embodiment, two creases are introduced into the cover 51, the spacing of which from one another corresponds exactly to the thickness of the folded sheet assembly 30, the creases therefore in the backed state coinciding exactly with the outer edges of the spine 31 of the brochure 32. Here, it is to be noted that the folded cover sheet feeder 50 does not necessarily fold the cover 51 at the weakening lines but instead in the middle of the sheet for the purpose of simplified stitching. In this case, this fold is advantageously a plow fold having a large radius, so that the folded line of the cover 51 does not stand out in the end product.

Between the last feeders 10, 12, 14 or the folded cover sheet feeder 50 and the stitching station 24, a thickness inspection with measuring device 33 is provided, in which the thickness of the folded sheet assemblies 30 to be stitched is determined.

The stitching station 24 in the present exemplary embodiment contains two stitching heads 26 and a respective crimper, which cannot be seen in the figures, assigned to the same which bends over wire staples 27 stuck by the stitching heads 26 into the folded sheet assemblies 30 to be stitched, specifically the legs of the wire staples 27 which have penetrated the folded sheet assemblies 30.

Following that, the pressing apparatus 40 according to the invention is disposed, which brings the spines of the gathered brochures 32 into a substantially rectangular form.

Figure 3:
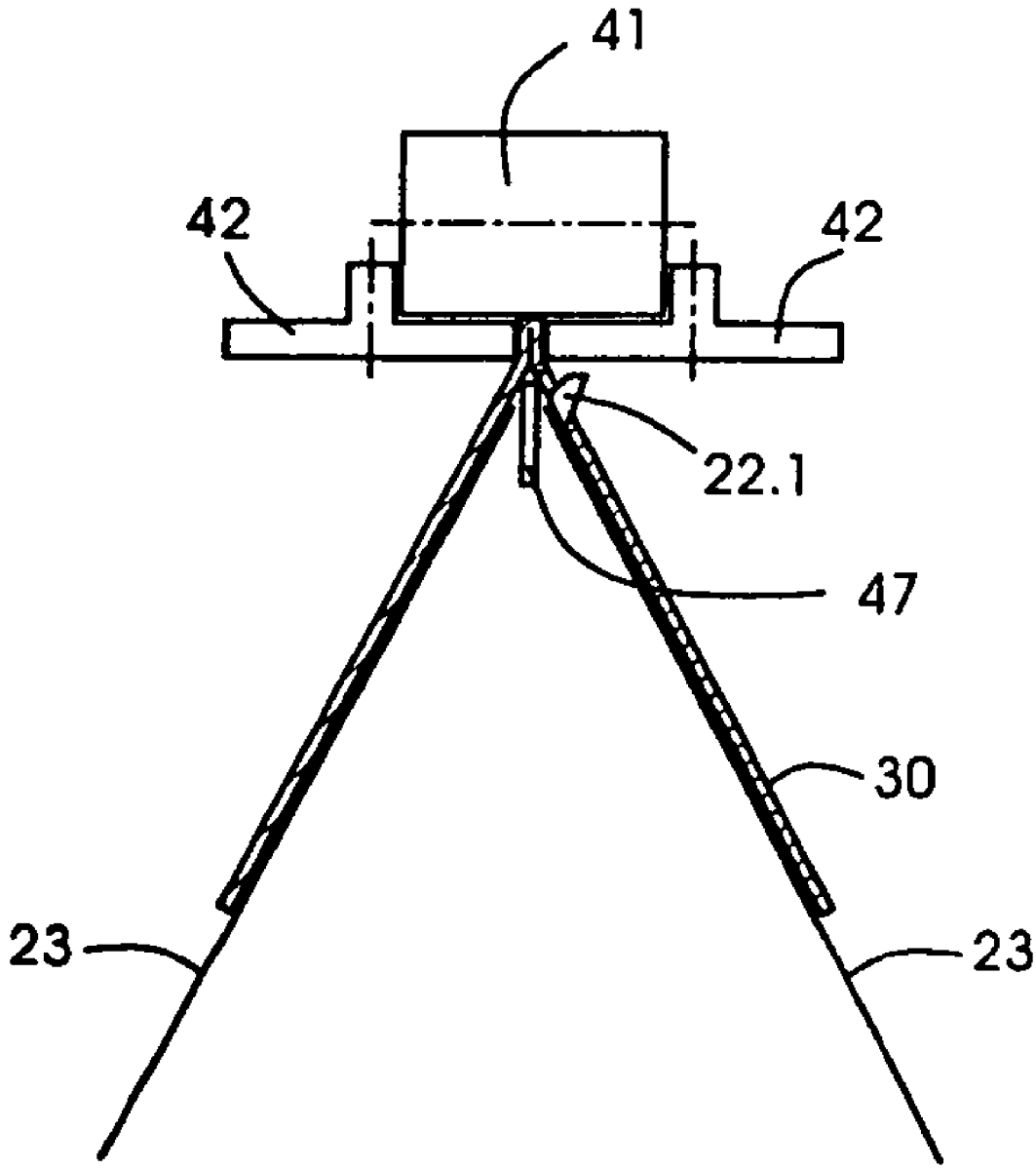
FIG. 3 is a diagrammatic, cross-sectional view through the first embodiment of the pressing apparatus according to the invention in a region of the backing of the spine of the brochure.

In FIGS. 2A-3, details of the pressing apparatus 40 according to the invention are shown only schematically. Drives, control elements, housings and other elements which are not essential to the invention and are left to the discretion of those skilled in the art have been left out for the purpose of improved clarity.

The pressing apparatus 40 illustrated in FIGS. 2A, 2B and 3 has a plurality of pressing elements 41, 42 above the transport and stitching line 22, namely an upper press roller 41 and two lateral press rollers 42, which are disposed on either side of the transport and stitching line 22, substantially in the region of the upper press roller 41, in particular somewhat upstream of the upper press roller 41.

To this end, the press rollers 42 have an appropriate step, so as not to block the upper press roller 41 and, at the same time, to preserve sufficient stability for the lateral press rollers 42, see FIG. 3. The shaping of the spine 31 is achieved substantially by the upper press roller 41 interacting with the lateral press rollers 42, and is carried out in a region in which the brochure 32 is still gripped firmly between the two lateral press rollers 42. These hold the upper edge of the brochure 32 somewhat underneath the stitching, after which the upper press roller 41 rolls the previously pointed upper edge of the brochure 32 flat, so that a rectangular form of the spine 31 is achieved. The lateral press rollers 42 and the upper press roller 41 are advantageously incorporated in a housing 45 of the pressing apparatus 40 in such a way that their position in relation to one another, in particular the spacing from one another along the transport direction P can be set variably.

A front hold-down roller 43 is placed upstream of the pressing elements 41, 42, and a rear hold-down roller 44 is placed downstream. The upstream hold-down roller 43 is used first to center the stitched brochure 32 as it runs in. However, both hold-down rollers 43, 44 are also used in particular to press the brochure 32 securely onto a dividing plate 47 as the brochure is backed by the pressing elements 41, 42, in order to prevent slipping during the backing and in this way to ensure the formation of the desired rectangular spine 31 of the brochure 32. In an advantageous refinement, the hold-down rollers 43, 44 are assigned running rollers located at the bottom in the region of the dividing plate 47, so that undesired marking of the signature resting on the dividing plate 47 as a result of the pressure is prevented. In addition, one or both of the hold-down rollers 43, 44 can have a profile for improved functionality, for example a circumferential groove, in order to improve the centering.

The rollers 41, 42, 43, 44 move with a circumferential speed which corresponds substantially to the transport speed of the brochure 32 along the transport and stitching line 22. In an advantageous embodiment, at least one of the rollers 41, 42, 43, 44 is configured to be driven, advantageously at least the press rollers 41, 42. The rollers 41, 42, 43, 44 are in each case fixed in a sprung manner to the housing 45 of the pressing apparatus 40. As a result, springing out in the event of a stoppage of the gatherer stitcher 5 is made possible.

The brochures 32, which are transported on saddle plates 23 by the transport and stitching line 22, are built up differently as a result of their possible different thickness, depending on the number and thickness of the collected signatures 16, 18, 20 and of the cover 51. This can be different from brochure 32 to brochure 32 in what is known as "selective binding" or "personalized binding". Therefore, all the adaptations of the thickness must be carried out upward from the ridge of the transport and stitching line 22 or the dividing plate 47, for example with respect to the lateral press rollers 42 and, in addition, also on both sides laterally with respect to the dividing plate 47, since the brochure is built up both in the height of the saddle and also in relation to its flanks, on which the lateral press rollers are disposed. Therefore, in each case position adjusting devices 41.1, 42.1, 43.1, 44.1 are provided, by which the position of the respective rollers 41, 42, 43, 44 with respect to the transport and stitching line 22 can be set. In this case, the position adjusting devices 41.1, 42.1, 43.1, 44.1, are for example, simple knurled wheels. Alternatively, these can also be actuating elements, in particular including those which are set automatically by a higher-order controller to the desired stipulated position, for example on the basis of information with regard to the thickness of the folded sheet assembly 30 which has been determined by the thickness inspection with the measuring device 33. Alternatively, however, automatic adjustment in response to information which is input by a user is also conceivable. The position adjusting devices 41.1, 42.1, 43.1, 44.1 can be used at the same time for setting the pressing force of the rollers 41, 42, 43, 44.

In addition to the position adjusting devices 41.1, 42.1, 43.1, 44.1 of the rollers 41, 42, 43, 44, non-illustrated position adjusting devices are provided, with which the complete pressing apparatus 40 (without dividing plate 47, saddle plates 23 and transport and stitching line 22) can be raised and/or lowered, depending on the embodiment, likewise under automatic control in response to information which is determined by the thickness inspection with measuring device 33 or is predefined by an operator or a higher-order controller. All the actuating elements can be, for example, motors, pneumatic cylinders or solenoids. The adaptation to respective brochure thickness is preferably made during continuous operation.

A driver 22.1 on the transport and stitching line 22 transports the brochure 32 along the transport direction P. The driver 22.1 is disposed on the transport and stitching line 22 in such a way that, in the region of the pressing apparatus 40, it runs underneath the lateral press rollers 42. In the region of the pressing apparatus 40, the brochure 32 lies astride the saddle plates 23. In the region of the pressing apparatus 40, the saddle plates 23 are lowered. In the upper region, the brochure 32 is supported by the dividing plate 47 under the ridge. In the region of the lateral press rollers 42, this dividing plate 47 has a cut-out 48, which is provided with an entry chamfer 49, in order to guide the backed part of the spine 31 of the brochure 32 onto the dividing plate 47 again without disruption.

As a result, by using the pressing apparatus 40, brochures 32 with a high-quality appearance can be produced which, as a result of the profiled angular spine 31, have a high inherent strength and consequently can be stood up better, for example in a bookshelf. In addition, possible labeling of the spine 31 is legible and therefore, for example, identification of the brochure 32 in the bookshelf is possible. In addition, with regard to the ability of the brochures 32 to be stacked, the printed products produced with the apparatus according to the invention in accordance with the method according to the invention are improved as a result of their reduced gaping behavior.

Figure 4A:
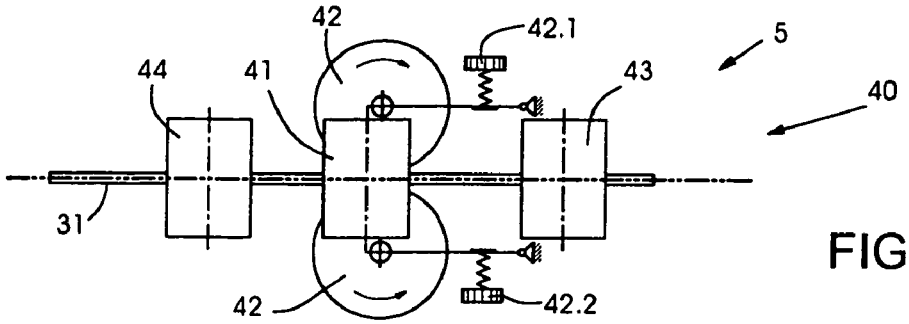
FIG. 4A is diagrammatic, plan view of details of a second embodiment of the pressing apparatus according to the invention.
Figure 4B:
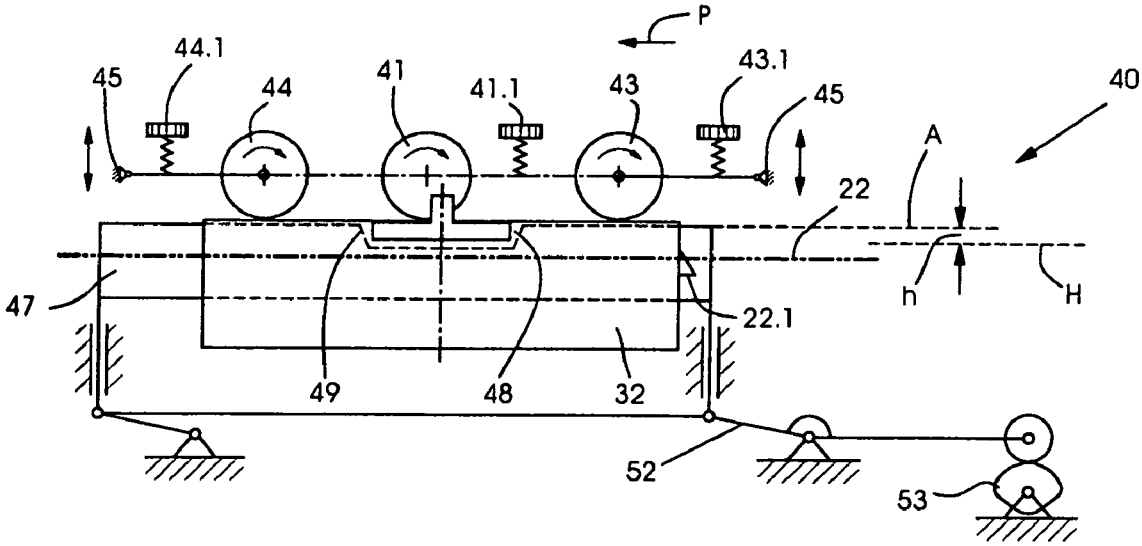
FIG. 4B is a diagrammatic, side-elevational view of details of the second embodiment of the pressing apparatus according to the invention.
Figure 5:
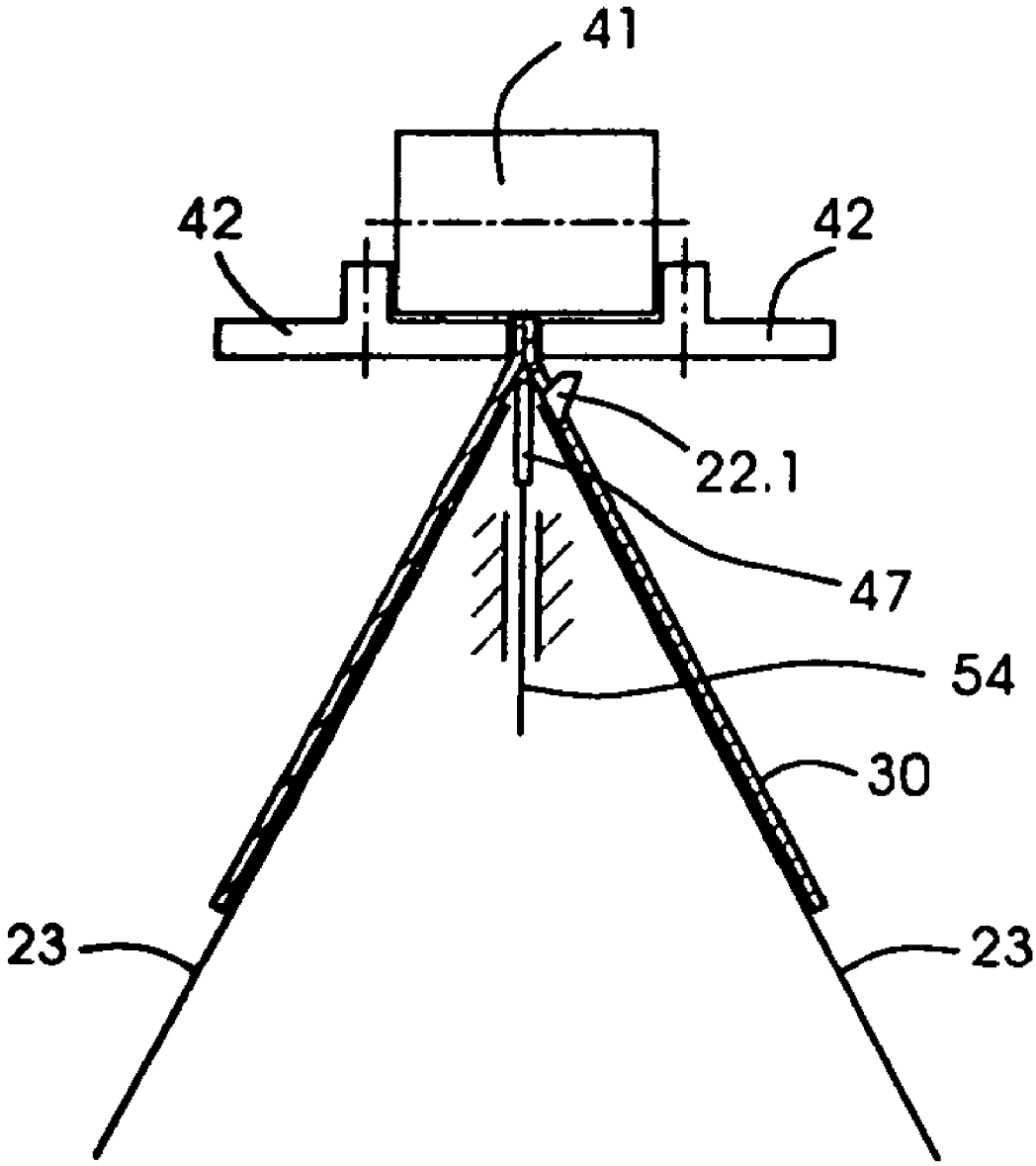
FIG. 5 is a diagrammatic, cross-sectional view of the second embodiment according to FIGS. 4A, 4B of the pressing apparatus according to the invention in the region of the backing of the spine of the brochure.

In a further embodiment, as illustrated in FIGS. 4A, 4B and 5, the dividing plate 47 is moved from a stitching position H by a lifting travel h into a backing position A via a coupler mechanism 52. The product is thus lifted off the transport and stitching line 22 by a lifting apparatus.

We claim:

1. A method for backing printed products, which comprises the steps of:

feeding signatures to a transport and stitching line of a gatherer stitcher using a plurality of feeders;

gathering the signatures on the transport and stitching line for forming a folded sheet assembly;

determining a product thickness of the brochure with a thickness inspector;

stitching the folded sheet assembly to form a brochure along the transport and stitching line;

automatically setting the pressing force of pressing elements and the position of the pressing elements and/or hold-down rollers of a pressing apparatus based on the determined product thickness of the brochure; and backing a spine of the brochure along the transport and stitching line using the pressing apparatus.

2. The method according to claim 1, which further comprises:

feeding a cover to the folded sheet assembly before performing the stitching step; and creasing the cover with a double crease in dependence on the product thickness of the folded sheet assembly.

3. The method according to claim 1, which further comprises, before being backed, moving the brochure out of a stitching position into a backing position.

4. A gatherer stitcher, comprising:

a transport and stitching line;

a plurality of feeders disposed along said transport and stitching line;

a thickness inspector for measuring a thickness of the folded sheet assembly on said transport and stitching line;

a stitching station disposed downstream of said feeders along said transport and stitching line;

a pressing apparatus disposed along said transport and stitching line downstream of said stitching station, said pressing apparatus producing a stitched-spine brochure having a rectangular spine, said pressing apparatus having a plurality of pressing elements and hold-down rollers; and a device for adjusting a position of said pressing apparatus, said device automatically carrying out, based on the measured thickness of the folded sheet assembly, an adjustment of the pressing force of said pressing elements and a position adjustment of said pressing elements and said hold-down rollers.

5. The gatherer stitcher according to claim 4, wherein said pressing elements and said hold-down rollers move with a transport speed of the stitched-spine brochures.

6. The gatherer stitcher according to claim 4, wherein at least one of said pressing elements or one of said hold-down rollers is mounted such that a spring force can be applied to it.

7. The gatherer stitcher according to claim 4, wherein a position of at least one of said pressing elements or said hold-down rollers is mounted such that its position with respect to a product thickness of the brochures can be adjusted.

8. The gatherer stitcher according to claim 4, wherein said pressing apparatus contains an upper pressing element and lateral press rollers for assisting in molding of the rectangular spine, said lateral press rollers being disposed in a region of said upper pressing element.

9. The gatherer stitcher according to claim 4, wherein said pressing apparatus is entirely mounted such that a position of said pressing apparatus can be adjusted in dependence on a product thickness of the brochures.

10. The gatherer stitcher according to claim 4, further comprising a folded cover sheet feeder having a device for producing a double crease in a cover with a variable spacing of creases corresponding to a measured product thickness of the folded sheet assembly.

11. The gatherer stitcher according to claim 4, wherein said transport and stitching line has saddle plates; and further comprising a dividing plate disposed in a region of said pressing apparatus, said dividing plate supporting said saddle plates of said transport and stitching line, said dividing plate having a cut-out formed therein, said cut-out having an entry chamfer at least in a transport direction.

12. The gatherer stitcher according to claim 11, further comprising a lifting apparatus for raising said dividing plate from a stitching position into a backing position.

13. The gatherer stitcher according to claim 12, wherein said lifting device is a cam-controlled coupler mechanism.

14. The gatherer stitcher according to claim 5, wherein a transport of the brochures is carried out by said pressing elements.

15. The gatherer stitcher according to claim 8, wherein said lateral press rollers are disposed upstream of said upper pressing element.

* * * * *